US005100006A

United States Patent [19]

Forrester

[11] Patent Number: 5,100,006

[45] Date of Patent: Mar. 31, 1992

[54] EYEGLASS DISPLAY STAND

[75] Inventor: G. Alden Forrester, Long Beach, Calif.

[73] Assignee: Forrester & Vos Company, Long Beach, Calif.

[21] Appl. No.: 759,526

[22] Filed: Sep. 13, 1991

[51] Int. Cl.[5] ..... A47F 7/00

[52] U.S. Cl. ..... 211/13; 248/902

[58] Field of Search ..... 211/13, 163, 87; 248/902

[56] References Cited

U.S. PATENT DOCUMENTS

| | | | |
|---|---|---|---|
| 993,404 | 5/1911 | Price | 248/902 X |
| 3,884,357 | 5/1975 | Bloch | 211/163 X |
| 5.016,759 | 5/1991 | Spamer | 211/13 |
| 5,025,931 | 6/1991 | Berger | 211/13 |
| 5,056,668 | 10/1991 | Berger | 248/902 X |

FOREIGN PATENT DOCUMENTS

| | | | |
|---|---|---|---|
| 1441581 | 7/1976 | United Kingdom | 248/902 |

*Primary Examiner*—Robert W. Gibson, Jr.

*Attorney, Agent, or Firm*—Charles H. Thomas

[57] ABSTRACT

A display rack is designed to display a multiplicity of sets of eyeglasses. A plurality of eyeglasses are mounted on each of a number of cantilevered eyeglass supporting elements. Each of these eyeglass supporting elements is comprised of a plurality of longitudinally aligned ridges forming eyeglass bridge supports. The ridges are broader at their bases than at their crests in a lateral direction. Upwardly facing support pads extend laterally outwardly in both directions from the base of each of the ridges, and transverse retainer walls extend laterally across the ends of each of the ridges to define eyeglass frame receiving pockets above the pads. An upwardly facing temple platform is located at a level above and behind the support pads for supporting the folded temples of a set of eyeglasses. The eyeglasses on each of the projecting, cantilevered supports are both accessible independently of each other. A prospective purchaser can select eyeglasses from either the front or rear of any of the cantilevered supporting elements without moving or removing any other set of eyeglasses.

13 Claims, 2 Drawing Sheets

EYEGLASS DISPLAY STAND

BACKGROUND OF THE INVENTION

1. Field of the Invention

The present invention relates to a stand with projecting devices suitable for concurrently displaying a plurality of eyeglasses.

2. Description of the Prior Art

At present merchants who sell eyeglasses encounter a significant problem in displaying the glasses for observation by prospective customers due to the large volume of space which is required to adequately display for sale the entire selection available. For example, nonprescription reading glasses are typically sold from upright, carrousel type display stands in which each set of reading glasses is displayed for sale in a single pocket-like compartment. Prospective purchasers reach into the various pockets and extract the eyeglasses therefrom to examine them for suitability of strength, frame size, frame color, and other variables.

Due to the many different eyeglass strengths, nose bridge sizes, temple piece sizes, colors and styles, the display of eyeglasses requires an extensive amount of space, very often in retail shopping areas where space is quite limited. Moreover, once a customer selects and purchases a set of eyeglasses, the compartment in which those glasses were displayed is then vacant. Until the retailer has the time to place a new, similar set of eyeglasses in the compartment, subsequent prospective purchasers who examine eyeglasses in the vicinity of vacant compartments, and who are not quite pleased with the eyeglasses still left, become discouraged if too many vacant compartments exist, such customers often decide to try other retail establishments for a greater selection.

One approach to the problem has been set forth in U.S. Pat. No. 4,976,532. This patent discloses a plastic hang tag system whereby a plastic display tag is attached to the bridge of the glasses and the glasses are suspended by means of an elongated display rod. A number of glasses may be suspended from the same rod by stringing the display hangers carrying the glasses onto the rod. One difficulty with this system, however, is that the prospective purchaser can examine the rearmost glasses only by removing all of the glasses in front. This arrangement restricts accessibility to all but the front set of eyeglasses.

SUMMARY OF THE INVENTION

The present invention involves an eyeglass display stand for simultaneously displaying a plurality of eyeglasses on each supporting element wherein each set of eyeglasses can be removed independently from the remainder of the displayed array regardless of whether the glasses are located in the front or behind other eyeglasses.

The invention involves a display rack in which a plurality of projecting pedestals are provided from an upright support. Each pedestal is generally triangular in shape and is specially configured to support two pairs of eyeglasses. The first pair of eyeglasses is supported at the cantilevered tip of each projection with the bridge of the frames resting on a convex upwardly facing ridge which resides between a front end plate and a first forward transverse retainer. The forward transverse face of the front end plate can be used as a billboard of sorts to display size, strength or other pertinent promotional information concerning the eyeglasses.

The width of the longitudinal ridge is tapered from top to bottom so as to be able to support eyeglass bridges of different width. At the lower extremities on both sides of the longitudinal front ridge there are flat, upwardly facing support pads which aid in laterally stabilizing the lenses of the glasses. The temples of the front pair of eyeglasses are folded and pass across a platform which is defined between the first forward transverse retainer and a first rear transverse retainer located therebehind. The flat expanse of the platform also provides lateral stability to prevent the eyeglasses from being tilted sideways or even falling off of the pedestal.

Behind the first rear transverse retainer there is another longitudinal ridge for supporting the bridge or nosepads of a second pair of eyeglasses. This second longitudinal ridge lies between the first rear transverse retainer and a second forward transverse retainer located therebehind. Flat, upwardly facing support pads are located on both lateral sides of the second longitudinal ridge. Behind the second forward transverse retainer there is a second platform, and behind that platform there is a second rear transverse retainer. Like the first platform, the second platform is designed to support the folded temples of a set of eyeglasses.

The walls of the recesses or pockets defined above the sets of upwardly facing pads are tapered downwardly toward each other, so that the pockets accommodate different sizes of glasses. The shape of the longitudinal ridges is configured to conform to the shapes of the bridges of different frames of eyeglasses positioned thereon. The pads beside the longitudinal ridges serve to provide added stability for supporting the lens frames of larger eyeglasses which extend all the way to the bottom of the crevasses defined between the transverse ridges between which the pads extend.

Preferably, an entire display may be formed as a single unitary structure with a plurality of projecting pedestals molded with the various transverse retainers extending convex upwardly and with corresponding concave recesses on their undersides. The use of the invention is not limited to reading glasses, but can be used for sunglasses, prescription glasses and any type of eyewear which is typically displayed for sale in retail outlets.

In one broad aspect the present invention may be considered to be a device for displaying a plurality of eyeglasses comprising: a longitudinally projecting cantilevered supporting element defining a plurality of longitudinally aligned eyeglass supports; each eyeglass support having a longitudinally oriented bridge supporting rib; a pair of laterally projecting, upwardly facing support pads at the base of said rib; transverse retainers longitudinally bounding said rib and said support pads, and an upwardly facing temple support platform located above and beyond the level of said support pads.

In another broad aspect the invention may be considered to be a rack for displaying eyeglasses comprised of a multiplicity of outwardly projecting, cantilevered supporting elements, each of which supports a plurality of eyeglasses and each of which is comprised of a plurality of longitudinally aligned ridges forming eyeglass bridge supports, said ridges being broader at their bases then at their crests in a lateral direction, upwardly facing support pads extending laterally outwardly in both directions from said bases of each of said ridges, transverse retainer walls extending laterally from both ends of each of said ridges to define eyeglass frame receiving pockets above said pads, and an upwardly facing temple platform at a level above said support pads located behind successive retainer walls for supporting the folded temples of sets of eyeglasses.

In a preferred embodiment of the invention each of the cantilevered supporting elements is adapted to support two sets of eyeglasses. Also, the rack has a central upright standard and the supporting elements are arranged in vertically spaced rows on the standard and project radially outwardly therefrom in an array of spaced vertical columns. Each of the cantilevered supporting elements projects outwardly from the standard at a downward inclination relative thereto, whereby the set of eyeglasses on each supporting element located most remote from the standard is supported at a slightly lower level than any other set of eyeglasses on the same support. Each of the supporting elements is widest where it is joined to the standard and narrowest at its extremity most remote from the standard. In each of the devices the transverse retainers are preferably formed as upright walls extending above the support pads and above the bridge supporting ribs.

Each cantilevered supporting element has an inner end adapted for securement to an upright mounting structure and an outer, remote end. The front, cantilevered remote end of each supporting element is formed with a broad, outwardly facing flat surface suitable for bearing printed information, such as eyeglass focal length, price or other information of interest to prospective purchasers. The inner end of each supporting element may include a transverse lip which is designed to reside in contact with the upright mounting structure. The lip of each cantilevered supporting element may be attached by glue or other conventional fastening means to the upright mounting structure. Preferably the lip is concealed from view when the supporting element is attached to the upright mounting structure.

The display rack of the present invention has a significant advantage over conventional display racks in that each of the sets of eyeglasses supported on each of the cantilevered supporting elements is readily accessible to a prospective purchaser. Unlike prior eyeglass display systems in which the consumer must first remove the front eyeglasses in order to remove eyeglasses located therebehind from the rack, any of the sets of eyeglasses can be removed from the rack without removing any other set of eyeglasses. As a consequence, a prospective purchaser is not bothered with having to remove and replace sets of eyeglasses which are not of interest in order to examine those which are.

On each of the projecting cantilevered supports the longitudinal raised ribs or ridges provide supports for the bridges of the eyeglass frames between the two lenses. The supporting pads on either side of the bases of the ribs or ridges provide lateral stability to the eyeglass frames and prevent the frames from tipping or falling off of the cantilevered supporting element. The platform or shelf behind the bridge support is broad enough in a lateral direction to provide good stability to support the eyeglass temples that are folded thereacross and supported from beneath.

Unlike eyeglass display stands which require the temples of sets of eyeglasses to be unfolded and extended for support during display, eyeglasses can be displayed with the temples folded in the display rack of the present invention. This provides an economy of space and allows a greater number of eyeglasses to be displayed within the same volume of space, as contrasted with some prior display devices. A multiplicity of different eyeglasses can thereby be displayed for sale on a carousel type rack which occupies a minimal amount of space.

The invention may be described with greater clarity and particularity with reference to the accompanying drawings.

DESCRIPTION OF THE EMBODIMENT

Figure 1:
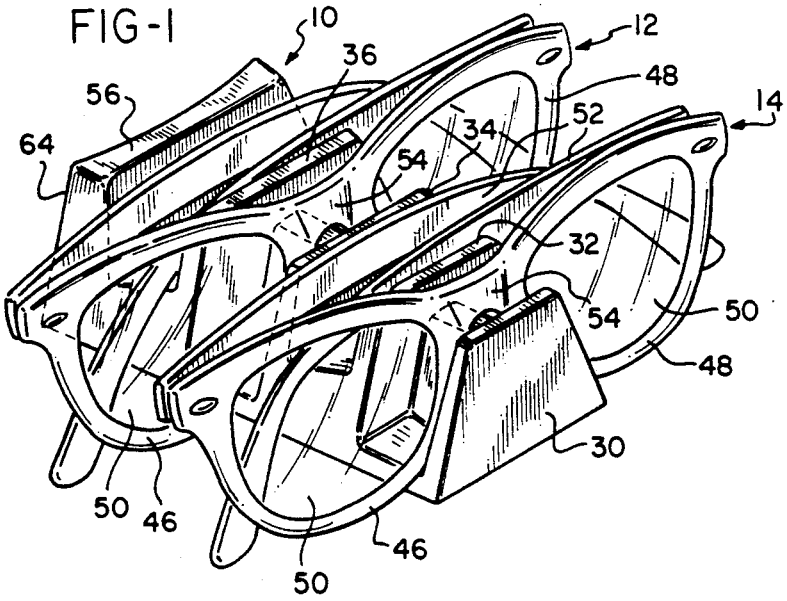
FIG. 1 is a perspective view showing a single display device according to the invention with two sets of eyeglasses supported thereon.

FIGS. 1–4 illustrate a single device 10 for concurrently displaying a pair of eyeglasses 12 and 14. The eyeglass display device 10 is comprised of a longitudinally projecting cantilevered supporting element 16 which has a generally trapezoidal shape as viewed both in the plan view of FIG. 2 and in the elevational view of FIG. 4. The supporting element 16 is a unitary molded plastic structure having an exposed convex upper surface, a concealed concave undersurface and a wall thickness of about 60 mils. The supporting element 16 may be about six inches in length and defines two eyeglass supports, one for supporting each of the two sets of eyeglasses 12 and 14.

Each of the eyeglass supports has a longitudinally oriented bridge supporting rib. These two ribs are depicted at 18 and 20 in the drawing figures. Each of the eyeglass supports also has a pair of laterally projecting, upwardly facing support pads at the base of each of the ribs. The pads 22 and 24 extend laterally outwardly on opposite sides of the base of the rib or ridge 18, while the support pads 26 and 28 extend laterally outwardly on opposite sides on the base of the second or rearmost rib 20. A front end partition or plate 30 and a first forward transverse retainer 32 define the boundaries of the first longitudinal rib 18 and the support pads 22 and 24, while a rear transverse retainer 34 and a second forward transverse retainer 36 likewise longitudinally bound the rib 20 and the support pads 26 and 28. An upwardly facing temple support platform 38 is located above and behind the level of the support pads 22 and 24 and behind the first forward transverse retainer 32. A similar upwardly facing temple support platform 40 is located above and behind the level of the support pads 26 and 28 and behind the second forward transverse retainer 36.

Each of the ribs or ridges 18 and 20 is of a generally trapezoidal cross section, when viewed from front to rear and has a pair of sides 42 and 44 that diverge from top to bottom. The cross-sectional shape of the ribs 18 and 20 is designed to conform to the generally trapezoidal or sinusoidal shape of the underside of a bridge of eyeglass frames between two adjacent lenses of a set of eyeglasses. While the bridges of some of the smaller sets of eyeglasses will reside perched atop the crests of the longitudinal ribs 18 and 20, in larger eyeglasses the lens frame sections 46 and 48 that carry the lenses 50 of each of the sets of eyeglasses 12 and 14 will rest atop the eyeglass pads 22, 24 and 26, 28 in the pockets defined between the transverse upright surfaces that bound the longitudinal extremities of the ribs 18 and 20. The pads 22-28 thereby serve to support the lens holding eyeglass frame sections 46 and 48 from beneath, and prevent the sets of eyeglasses 12 and 14 from rocking laterally on the cantilevered supporting element 16.

The forward upright transverse end plate 30 has a flat, forwardly facing surface 32 that is suitable for display of printed information. Gummed labels with eyeglass strength, price, brand name or other information of interest can be displayed on the outwardly facing front surface of the end plate 30.

Behind the longitudinal rib 18 and eyeglass support pads 22 and 24 the forward transverse retainer 32 extends upwardly at a slight incline relative to the vertical and forms a back wall for the eyeglass frame pockets defined above the support pads 22 and 24. The wall formed by the transverse retainer 32 extends upwardly above the level of the crest of the longitudinally extending rib 18 a distance of about one half to three quarters of an inch. The front walls of the pockets above the pads 22 and 24 are formed by the obverse side of the front end plate 30 while the front walls of the pockets above the pads 26 and 28 are formed by the back side of the transverse retainer 34.

The upwardly facing temple support platform 38 has a generally trapezoidal shape as viewed from above. The forward transverse retainer 32 and the rear transverse retainer 34 for the front eyeglass support, together with the temple support platform 38, form a channel-shaped structure extending transversely across the supporting element 16. As illustrated in FIG. 1, when the temples 52 of the set of eyeglasses 14 are folded they rest atop the temple support platform 38. At the same time the rib 18 and support pads 22 and 24 respectively support the bridge 54 and the lens holding sections 46 and 48 of the front set of eyeglasses 14.

The transverse rear retainer 34 for the front eyeglass support also serves as an upright transverse separator located behind the first or forward temple platform 38. The retaining wall formed by the retainer 34 extends a distance of about one half inch above the temple support platform 38.

Figure 4:
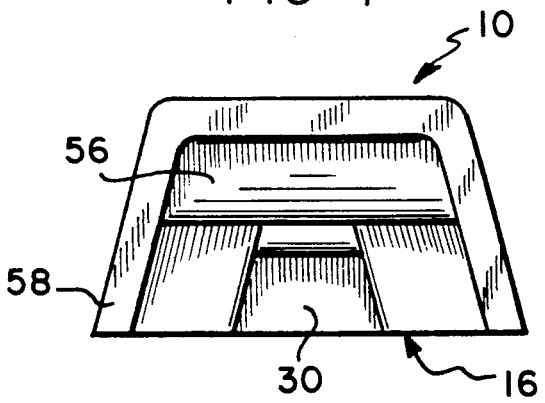
FIG. 4 is a rear elevational view of the eyeglass display device of FIG. 1.

The rear face of the first rear transverse retainer 34 for the front eyeglass support forms a forward boundary wall across the front of the rearmost longitudinally extending rib 20. At the rear extremity of the rearmost rib 20 the second forward retainer 36 rises from the base of the rib 20 and the flat, upwardly facing eyeglass support pads 26 and 28 to a level approximately one half to three quarters of an inch above the crest of the rib 20. Behind the second forward retainer 36 the rearmost temple support platform 40 extends transversely across the supporting element 16. The rearmost temple platform 40 is bounded by a second rear transverse end retainer 56. As illustrated in FIG. 4, an inwardly projecting marginal lip 58 extends downwardly from the back side of the transverse end retainer 56 and inwardly from the side walls of the supporting element 16.

Figure 2:
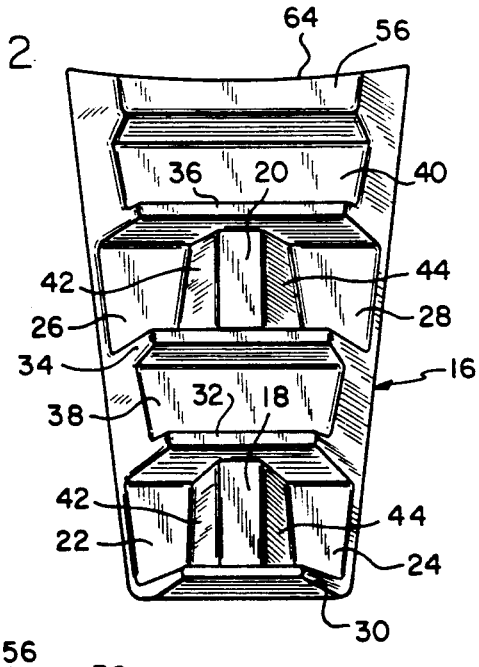
FIG. 2 is a top plan view of the eyeglass display device of FIG. 1.
Figure 6:
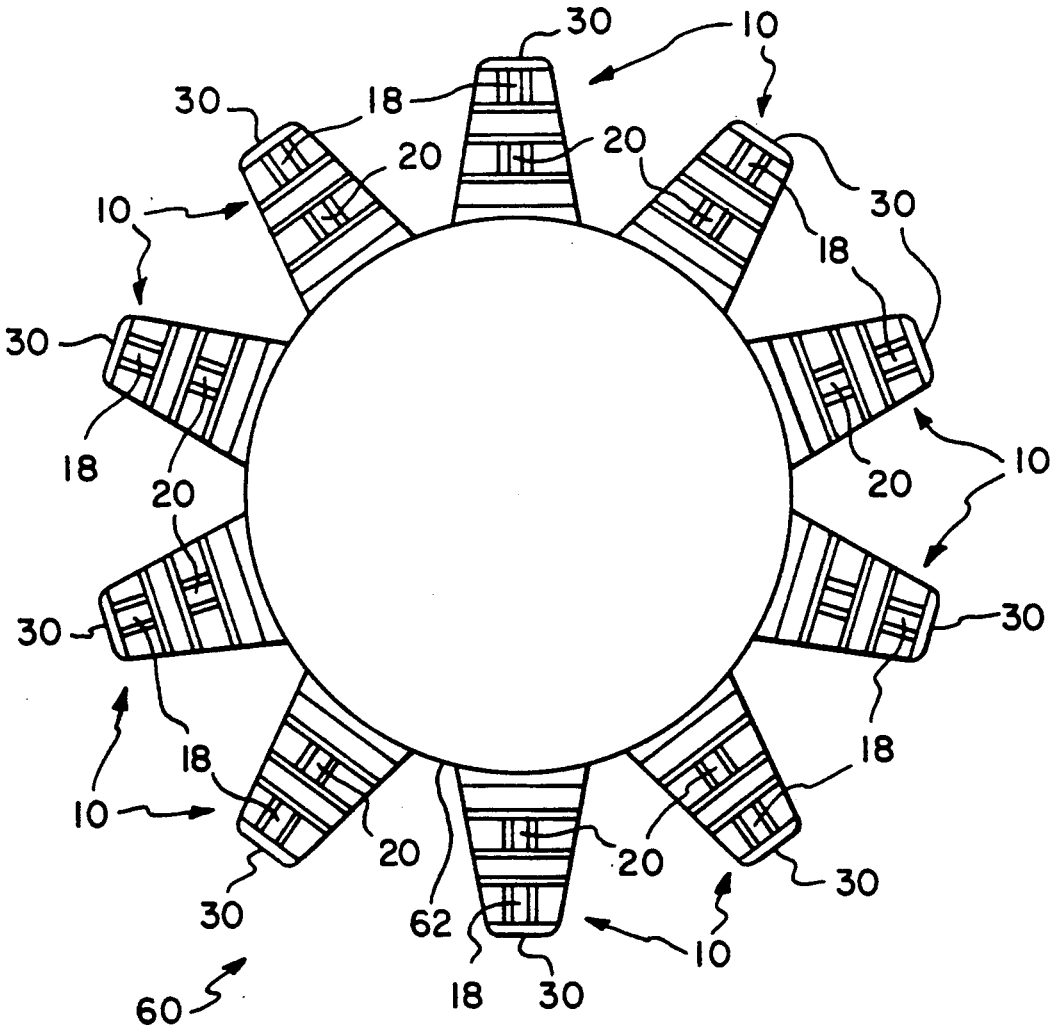
FIG. 6 is a top plan view of the eyeglass display rack of FIG. 5.

FIG. 6 is a plan view of a rack 60 for displaying eyeglasses. The eyeglass display rack 60 is comprised of a central, cylindrical upright standard 62, which is preferably a hollow cylindrical structure having a diameter of about 16.6 inches. The rack 60 is comprised of a multiplicity of the outwardly projecting devices 10 of the type depicted and described in detail in conjunction with FIGS. 1-4. Each of the devices 10 is glued onto the convex outwardly facing surface of the cylindrical standard 62 by means of glue applied to the marginal lip 58. As illustrated in FIGS. 1 and 2, the rear surface 64 of each supporting elements 16 is configured with a concave, arcuate curve that matches the convex curvature of the outer surface of the cylindrical standard 62. The glue lips 58 of the display devices 10 thereby establish intimate secure contact against the outer surface of the cylindrical standard 62.

Figure 5:
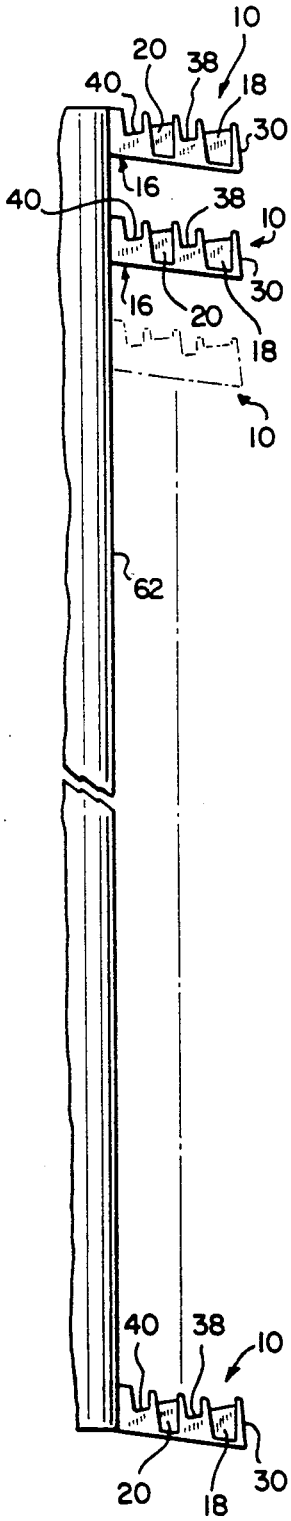
FIG. 5 is a side elevational view of a portion of a display rack comprised of a multiplicity of the supporting elements depicted in FIGS. 1–4.

As illustrated in FIGS. 5 and 6, the supporting devices 10 are arranged in vertically spaced rows on the standard 62. The supporting devices 10 project radially outwardly from the standard 62 in an array of laterally spaced vertical columns about the circumference of the upright standard 62. In the embodiment depicted in FIGS. 5 and 6 the devices 10 may be arranged on the display rack 60 in 10 columns projected radially outwardly from the central cylindrical core or standard 62 in perhaps 18 laterally spaced rows. The devices 10 will be arranged in different numbers of columns and rows depending upon the diameter and length of the central cylindrical standard or column 62.

Figure 3:
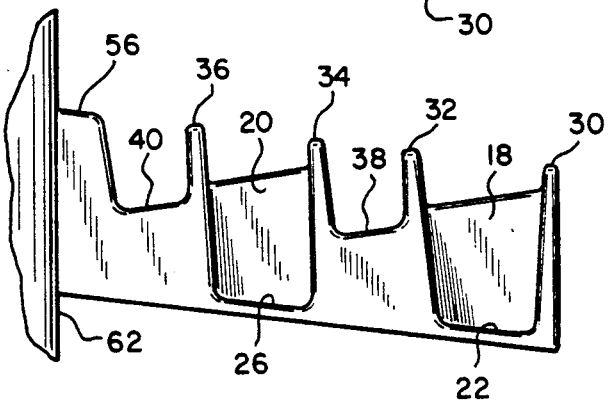
FIG. 3 is a side elevational view of the eyeglass display device of FIG. 1.

As best illustrated in FIGS. 2 and 4, each of the supporting elements 16 is widest at its glue lip 58 where it is joined to the upright cylindrical standard 62 and narrowest at its front extremity where the front end plate 30 is located remote from the standard 62. Also, as illustrated in FIG. 3 each of the supporting elements 16 projects outwardly from the standard 62 at a downward inclination relative thereto. As a result, the set of eyeglasses 14 on each supporting element 16 that is located most remote from the standard 62 is supported at a lower level than any other set of eyeglasses on the same support, namely the set of eyeglasses 12. This further facilitates accessibility of the rearmost set of eyeglasses 12 to prospective purchasers.

In an eyeglass display rack 60 of the type depicted in FIGS. 5 and 6 in which there are 18 rows and ten columns of eyeglass display devices 10, a total of 360 eyeglasses may be supported for display to prospective purchasers. Each of the sets of eyeglasses is arranged with its bridge 54 residing atop either a ridge 18 or a ridge 20 and with its temples 52 folded behind the upright retainer at the rear of the rib across one of the temple supporting platforms 38 or 40. Prospective purchasers can easily reach and remove either the set of eyeglasses 12 or the set of eyeglasses 14 from any of the supporting devices 10 without having to first remove any other set of eyeglasses on the entire display rack 60. Thus, prospective purchasers are afforded access to a great many choices of sets of eyeglasses which are displayed in a highly compact area.

Once a prospective purchaser removes a set of eyeglasses 12 or 14 from a display device 10, the purchaser can easily replace those eyeglasses in the eyeglass support from which it is withdrawn, or, if desired, the purchaser may take the eyeglasses selected to the clerk to effectuate a purchase. In this case another set of eyeglasses is taken from stock and placed in the eyeglass support vacated by the set of eyeglasses selected for purchase. This can either be done immediately or during subsequent restocking of the display rack 60.

Undoubtedly, numerous variations and modifications of the invention will become readily apparent to those familiar with the display of eyeglasses. The size and shape of each of the display devices 10 and the arrangement of a multiplicity of those devices on a display rack can be varied substantially. Also, the number of display devices used on a display rack can be varied according to the requirements and space available in different retail eyeglass sales locations. Furthermore, the number of sets of eyeglasses which can be mounted on a single one of the display devices 10 can be increased as required by replicating the number of bridge supporting ribs, support pads, transverse retainers and temple support platforms and by lengthening the display devices to accommodate three or even more sets of eyeglasses. Accordingly, the scope of the invention should not be construed as limited to the specific embodiments of the display device and display rack depicted and described, but rather as defined in the claims appended hereto.

I claim:

1. A device for displaying a plurality of eyeglasses comprising:

a longitudinal projecting cantilevered supporting element defining a plurality of longitudinally aligned eyeglass supports, each eyeglass support having:

a longitudinally oriented bridge supporting rib, a pair of laterally projecting upwardly facing support pads at the base of said rib, transverse retainers longitudinally bounding said rib and said support pads, and an upwardly facing temple support platform located above and behind the level of said support pads.

2. A device according to claim 1 wherein said transverse retainers are formed as upright walls extending above said support pads and above said bridge supporting rib.

3. A device according to claim 2 wherein the foremost transverse retainer is formed with an outwardly facing flat surface suitable for bearing printed information.

4. A device according to claim 1 wherein said supporting element has an inner end adapted for securement to an upright mounting structure and an outer, remote end, and said outer end has a flat, exposed transverse surface suitable for displaying printed information.

5. A display device for supporting a plurality of eyeglasses for display for sale comprising:

a cantilevered projecting support defining:

a forward upright transverse end retainer, a first bridge support including a longitudinally aligned first rib having a base and sides converging upwardly from said base to a crest, and first, flat, upwardly facing, support pads extending laterally outwardly on opposite sides of said base of said first rib and rearwardly from said forward end retainer, a first intermediate upright, transverse retainer extending laterally outwardly on opposite sides of and behind said first rib and upwardly behind said first support pads, a first, flat, upwardly facing temple support platform located behind and beneath the level of the top of said first intermediate retainer and above the level of said first support pads, at least one upright, transverse separator located behind said first temple support platform and extending upwardly therefrom, at least one additional bridge support including an additional longitudinally aligned rib having a base and sides converging upwardly from said base to a crest and rearwardly from said transverse separator, and additional, flat, upwardly facing support pads extending laterally outwardly on opposite sides of said base of said additional rib and rearwardly from said transverse separator, at least one additional upright transverse retainer extending laterally outwardly on opposite sides of and behind said additional rib and upwardly behind said additional support pads, at least one additional temple support platform located behind and beneath the level of the top of said additional transverse retainer and above the level of said additional support pads, and a rear, transverse end retainer.

6. A display device according to claim 5 wherein said sides of said projecting support diverge rearwardly.

7. A display device according to claim 5 wherein said forward upright transverse end retainer has a flat, forwardly facing surface suitable for bearing printed information to be displayed.

8. A display device according to claim 5 wherein said projecting support is a unitary molded plastic structure.

9. A rack for displaying eyeglasses comprised of a multiplicity of outwardly projecting, cantilevered supporting elements each of which supports a plurality of eyeglasses and each of which is comprised of a plurality of longitudinally aligned ridges forming eyeglass bridge supports, said ridges being broader at their bases than at their crests in a lateral direction, upwardly facing support pads extending laterally outwardly in both directions from said bases of each of said ridges, transverse retainer walls extending laterally from both ends of each of said ridges to define eyeglass frame receiving pockets above said pads, and an upwardly facing temple platform at a level above said support pads located behind successive retainer walls for supporting the folded temples of sets of eyeglasses.

10. A rack according to claim 9 wherein each of said cantilevered supporting elements is adapted to support two sets of eyeglasses.

11. A rack according to claim 9 further comprising a central upright standard and said supporting elements are arranged in vertically spaced rows on said standard and project radially outwardly therefrom in an array of spaced vertical columns.

12. A rack according to claim 11 wherein each of said cantilevered supporting elements projects outwardly from said standard at a downward inclination relative thereto, whereby the set of eyeglasses on each supporting element located more remote from said standard is supported at a lower level than any other set of eyeglasses on the same support infringement.

13. A rack according to claim 11 wherein each of said supporting elements is widest where it is joined to said standard and narrowest at its extremity most remote from said standard.

* * * * *